United States Patent [19]

Beckers et al.

[11] 4,429,513

[45] Feb. 7, 1984

[54] APPARATUS FOR ENCLOSING OBJECTS

[75] Inventors: Hans Beckers, Monchen-Gladbach; Klaus Vollmer, Viersen, both of Fed. Rep. of Germany

[73] Assignee: Robert Bosch GmbH, Stuttgart, Fed. Rep. of Germany

[21] Appl. No.: 285,682

[22] Filed: Jul. 21, 1981

[30] Foreign Application Priority Data

Aug. 16, 1980 [DE] Fed. Rep. of Germany ..... 3030915

[51] Int. Cl.[3] ..... B65B 9/06

[52] U.S. Cl. ..... 53/547; 53/550

[58] Field of Search ..... 53/547, 370, 220, 549, 53/550

[56] References Cited

U.S. PATENT DOCUMENTS

| | | | |
|---|---|---|---|
| 2,584,060 | 1/1952 | Stephano | 53/547 |
| 3,001,351 | 9/1961 | Brook et al. | 53/547 X |
| 3,236,021 | 2/1966 | Wagner et al. | 53/547 X |

*Primary Examiner*—Horace M. Culver

*Attorney, Agent, or Firm*—Edwin E. Greigg

[57] ABSTRACT

An apparatus for enclosing objects, for example, candies, with a sheet of packaging material has a tube forming and guiding apparatus. To tightly fit the tube to the objects, an elastic collar is arranged at the end of the tube forming and guiding apparatus in the shape of a funnel and under tension, so that the collar presses the tube against the objects and forces superfluous packaging material into an overlap of the packaging material edges.

3 Claims, 2 Drawing Figures

APPARATUS FOR ENCLOSING OBJECTS

BACKGROUND OF THE INVENTION

The invention relates to an apparatus for enclosing solid objects with a sheet of packaging material, which includes tube forming and guiding apparatus for continuously wrapping a sheet of packaging material about objects being supplied in sequence to the apparatus.

In known apparatus of this type, for example, the apparatus described in the German Patent DE-AS No. 11,52,050 the tube forming and guiding arrangement has a forming stack for continuously forming the sheet of packaging material into a tube enclosing the objects, for example candies, and two conveyer belts which grip the tube with the enclosed objects between themselves. A shear abuts the conveyer belts and cuts off separate tube pieces, each enclosing a single object. It has been seen that in many cases the tube does not wrap tightly around the enclosed object due to variations in thickness of the objects, so that a longitudinal crease is visible in the wrapping after twisting together the tube ends. Thus it is desirable to embody the apparatus in such a manner that the tube of packing material tightly fits the object to be enclosed, so as to avoid such a crease which negatively influences the appearance of the wrapping.

OBJECT AND SUMMARY OF THE INVENTION

Therefore, it is a primary object of the invention to provide an improved apparatus of the type described above for enclosing objects, which has a simple and cheaply manufacturable construction and whereby tight wrappings are always attained around the objects.

This object of the invention is obtained by the tube forming and guiding apparatus, according to the invention, having a delivery end which is embodied in a pliable manner. It is especially advantageous to embody the delivery end as a collar of elastic material.

The invention will be better understood and further objects thereof will become more apparent from the ensuing detailed description of a preferred embodiment taken in conjunction with the drawings.

DESCRIPTION OF THE PREFERRED EMBODIMENT

Figure 1:
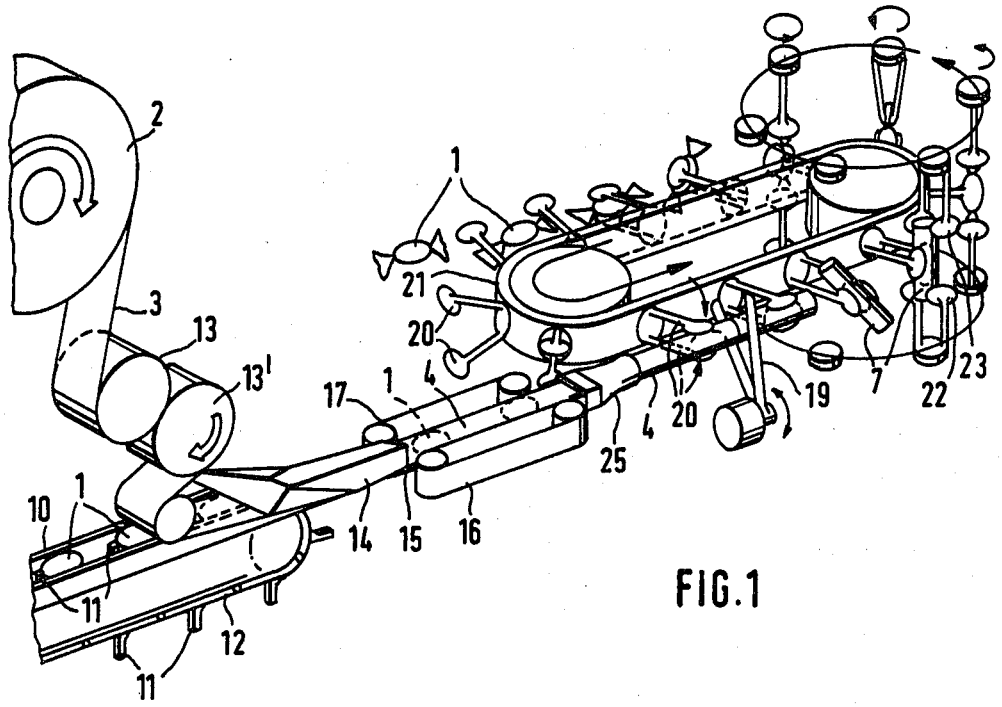
FIG. 1 shows a perspective, simplified view of a machine for wrapping objects.
Figure 2:
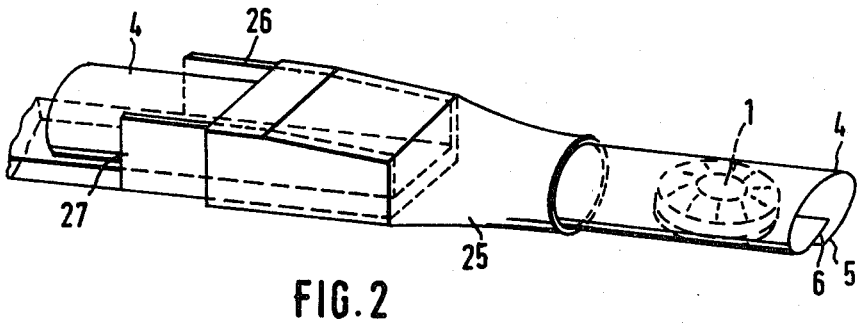
FIG. 2 shows a perspective, simplified view of the delivery end of the forming and guiding arrangement for the machine for wrapping objects according to FIG. 1.

Objects 1 are supplied to a forming stack 14 in equal distances on a horizontal plane in a channel 10 via flight attachments 11 of a continuously rotating, endless supply chain 12. A flexible packaging material sheet 3 is also dispensed from a supply reel 2 into the forming stack 14 via two feed rollers 13, 13'. The packaging material sheet 3 is continuously shaped into a tube 4 around the objects being guided into the forming stack 14. This tube 4 has edges 5, 6 that overlap each other at their base. The tube 4 with the enclosed objects is pulled through the forming stack 14 by two abutting, continuously-driven, conveyor belts 16, 17. The tube 4 slides on a plate 15 and is guided to a conveyor apparatus 21 provided with gripping tongs 20. After gripping the tube end with one gripping tong each in the region of an enclosed object 1, a shear 19 severs off one tube section 7 at a time from the end of the tube 4. The gripping tongs 20 then rotate the gripped tube sections 7 into a vertical position and pass through a rerouting path in which twisting tools 22, 23 twist shut the end of the tube section 7 protruding beyond the ends of the object 1. The thus enclosed objects 1 are then released by an opening of the gripping tongs 20.

A pliable element which surrounds the tube 4 is disposed at the end of the tube forming and guiding arrangement to which the forming stack 14, the plate 15, and the conveyor belts 16, 17 belong, so that the wrapping, i.e., the tube section 7, fits tightly to the objects 1. In the shown preferred embodiment, the pliable element consists of a funnel or collar 25 made of rubber. The collar 25 is connected at one end to a U-shaped guidance device which is formed by the end of the plate 15 which protrudes beyond the conveyor belts 16, 17 and by side walls 26, 27 arranged on the plate 15 on both sides thereof. The collar 25 which, in a non-expanded condition, has a clear width which is slightly smaller than the cross-section of the object 1, is expanded at its one end and is superimposed onto the side walls 26, 27 under tension. The height of the side walls 26, 27 diminishes in the direction of supply of the objects 1 and the tube 4, so that at the entering position of the tube 4 onto the collar 25 the upper wall of the collar 25 does not touch the tube 4, but at the end of the side walls 26, 27 it presses the tube 4 against the objects 1 from above. The free end of the collar 25 which further narrows down away from the end of the side walls 26, 27 then initially presses the tube 4 against the objects 1 adjacent to the end of the side walls 26, 27 and the finally presses from the bottom as well, where the edges 5, 6 of the packaging material sheet 3 overlap each other. This forces superfluous packaging material into overlapping. The circumference of the collar 25 is chosen such, that it is approximately 2 mm smaller than the largest circumference of the object 1 to be enclosed when the collar 25 is in a non-expanded condition.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. In an improved apparatus for enclosing solid objects with a sheet of packaging material into a tight wrapping including means for feeding the solid objects to be wrapped in an evenly spaced manner to an input end of a tube forming and guiding means for dispensing a flexible packaging material from a supply reel into said tube forming and guiding means which shapes the flexible packaging material into a tube surrounding said solid objects and carries said solid objects to an outlet end of said tube forming and guiding means, means for cutting the shaped tube formed about the solid objects into uniform lengths, and means for twisting the ends of the cut shaped tubes to securely enclose the solid objects with the tube, the improvement comprising a collar of elastic material secured to and surrounding an output end of said tube forming and guiding means through which said solid objects enclosed in a formed tube of packaging material passes, said collar of elastic material has a smaller cross section than the cross section of said solid objects and surrounds the wrapped objects as they pass through so that said tube of packaging material is formed to tightly fit around said solid objects as said solid objects leave the output end of said collar of elastic material.

2. An apparatus according to claim 1, characterized in that the collar is superimposed onto two stationary side walls of said tube forming and guiding means.

3. An apparatus according to claim 2, characterized in that the height of the side walls supporting the collar diminishes in the direction of supply of the solid objects.

* * * * *